US011142007B2

(12) United States Patent
Murayama et al.

(10) Patent No.: US 11,142,007 B2
(45) Date of Patent: Oct. 12, 2021

(54) PRINTING APPARATUS AND PRINTING ADJUSTMENT METHOD

(71) Applicant: SEIKO EPSON CORPORATION, Tokyo (JP)

(72) Inventors: Osamu Murayama, Yamagata-Mura (JP); Shinya Yamazaki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 68 days.

(21) Appl. No.: 16/800,690

(22) Filed: Feb. 25, 2020

(65) Prior Publication Data

US 2020/0276845 A1 Sep. 3, 2020

(30) Foreign Application Priority Data

Feb. 28, 2019 (JP) ..... JP2019-036265

(51) Int. Cl.
*B41J 25/308* (2006.01)
*B41J 11/00* (2006.01)

(52) U.S. Cl.
CPC ..... *B41J 25/308* (2013.01); *B41J 11/0095* (2013.01); *B41J 2203/011* (2020.08)

(58) Field of Classification Search
CPC ..... B41J 25/308; B41J 11/0095; B41J 2203/011; B41J 29/38; B41J 29/393; B41J 2029/3935
See application file for complete search history.

(56) References Cited

U.S. PATENT DOCUMENTS 6,000,776 A * 12/1999 Suzuki ..... B41J 2/2139 347/14
2014/0022298 A1* 1/2014 Li ..... B41J 2/04556 347/19
2016/0089883 A1 3/2016 Yokota

FOREIGN PATENT DOCUMENTS

JP 2008019021 A * 1/2008 ..... B41J 2/155
JP 2016-064622 4/2016

* cited by examiner

*Primary Examiner* — Julian D Huffman
(74) *Attorney, Agent, or Firm* — Workman Nydegger

(57) ABSTRACT

Provided is a printing apparatus including a platen portion including a platen surface on which a medium is disposed, and a carriage including a printing head and a distance sensor, the carriage being configured to move in a direction B on the platen surface. The printing apparatus further includes a control unit configured to move the carriage to measure, by using the distance sensor, a distance to the medium at each position to which the carriage moves, and to specify, based on information of the position and the distance, a position of an adjustment pattern printing range in which an adjustment pattern is printed on the medium.

7 Claims, 5 Drawing Sheets

PRINTING APPARATUS AND PRINTING ADJUSTMENT METHOD

The present application is based on, and claims priority from JP Application Serial Number 2019-036265, filed Feb. 28, 2019, the disclosure of which is hereby incorporated by reference herein in its entirety.

BACKGROUND

1. Technical Field

The present technology relates to a printing apparatus for performing printing on a medium and a printing adjustment method.

2. Related Art

Many of printing apparatuses such as inkjet printers perform printing adjustment prior to printing on a medium to maintain print quality. In the printing adjustment, an adjustment pattern is printed on the medium, the concentration of the adjustment pattern is detected by a concentration sensor, and an ink ejection timing and the like are adjusted based on the detection result (JP-A-2016-064622).

However, the posture of a medium disposed on a platen surface may partially have floating (cockling) due to stretching caused by, for example, heat from a platen heater and drying (moisture absorption) resulting from an environment.

The adjustment pattern is expected to be printed on a planar surface of the medium. Therefore, when the adjustment pattern is printed on the portion of the medium where the floating occurs, the adjustment pattern itself will be varied from the original pattern, making it difficult to perform effective adjustments. Typically, this regard has not been considered, and thus, there is a problem that an adjustment pattern needs to be printed more than once to properly adjust printing, and a medium and ink are wasted for the printing adjustment.

SUMMARY

A printing apparatus according to an aspect of the present disclosure to solve the above-described problem includes a platen portion including a platen surface on which a medium is disposed, a carriage including a printing head and a distance sensor, the carriage being configured to move, and a control unit configured to move the carriage to measure, by using the distance sensor, a distance to the medium at each position, and to specify, based on information of the position and the distance, a position of an adjustment pattern printing range in the medium.

DESCRIPTION OF EXEMPLARY EMBODIMENTS

Figure 1:
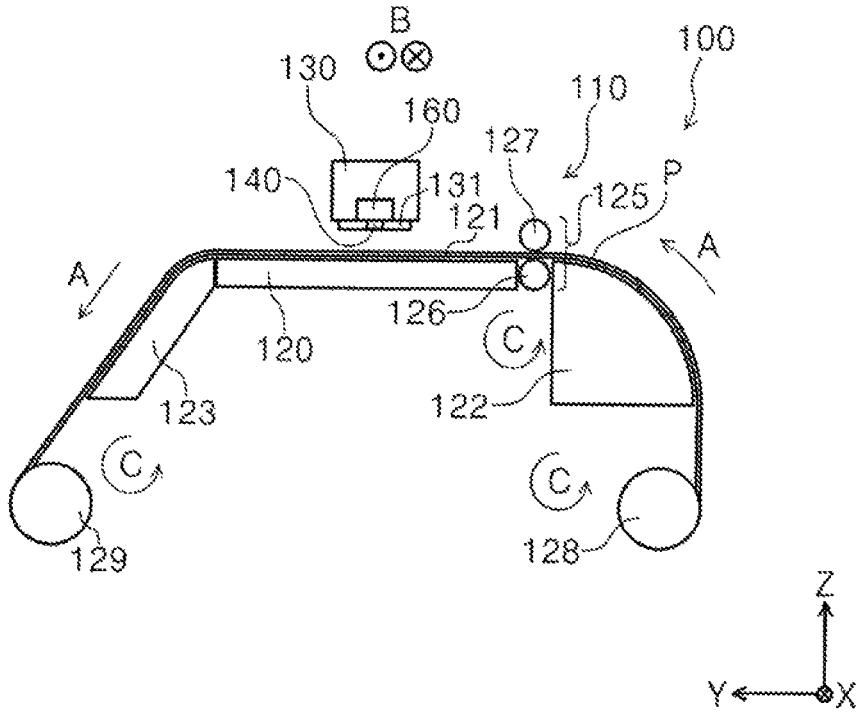
FIG. 1 is a schematic side view of a printing apparatus according to an embodiment of the present disclosure.

First, the present disclosure will be schematically described.

A printing apparatus according to a first aspect of the present disclosure includes a platen portion including a platen surface on which a medium is disposed, a carriage including a printing head and a distance sensor, the carriage being configured to move, and a control unit configured to move the carriage to measure, by using the distance sensor, a distance to the medium at each position, and to specify, based on information of the position and distance, a position of an adjustment pattern printing range in the medium.

In other words, in the first aspect, a printing apparatus includes a platen portion including a platen surface on which a medium is disposed, a carriage including a printing head and a distance sensor, the carriage being configured to move, and a control unit configured to move the carriage to measure, by using the distance sensor, a distance to the medium at each position, and to specify, based on information of a change in the distance, a position of an adjustment pattern printing range in the medium.

According to this aspect, the control unit specifies the position of the adjustment pattern printing range in the medium, based on the information of the change in the distance to the medium obtained by moving the distance sensor. Thus, even when floating partially occurs in the medium disposed on the platen surface, a range of the medium in which floating does not occur can be specified and the adjustment pattern can be printed. Accordingly, the printing adjustment can be appropriately performed without repositioning the medium. That is, the printing adjustment can be performed easily.

A printing apparatus according to a second aspect of the present disclosure has a configuration such that in the printing apparatus according to the first aspect, the adjustment pattern printing range is a region in which the change in the distance to the medium is equal to or less than a predetermined amount.

Here, the "predetermined amount" is a threshold value of the change in the distance and is given in advance. In addition, the "region" in the "region in which the change in the distance to the medium is equal to or less than a predetermined amount" refers to a continuous section on the medium surface that is wider than a region occupied by the adjustment pattern to be printed.

According to this aspect, the adjustment pattern printing range is the region in which the change in the distance to the medium is equal to or less than the predetermined amount. In other words, the adjustment pattern is printed in the region in which the change in the distance to the medium is equal to or less than the predetermined amount. This facilitates the printing adjustment.

A printing apparatus according to a third aspect of the present disclosure has a configuration such that in the printing apparatus according to the first aspect, the adjustment pattern printing range is the region in which a difference between the distance to the medium measured by the distance sensor and a distance from the distance sensor to the platen surface is equal to or less than a predetermined value.

Here, the "predetermined value" is a threshold value set based on a thickness of the medium, for example. That is, in the region where the difference between the distance to the medium measured by the distance sensor and the distance from the distance sensor to the platen surface is equal to or less than the predetermined value, there is little floating in the medium.

According to this aspect, the adjustment pattern printing range is the region having a value equal to or less than the predetermined value being a threshold value set based on the thickness of the medium, for example. This facilitates the printing adjustment.

A printing apparatus according to a fourth aspect of the present disclosure has a configuration such that in the printing apparatus according to any one of the first to third aspects, the control unit is configured to issue a notification when failing to acquire the adjustment pattern printing range.

According to this aspect, if a range corresponding to the adjustment pattern printing range is not present in the medium as a result of measuring the medium, the control unit notifies a user that there is not the range. As a result, the user can know that there is not the range corresponding to the adjustment pattern printing range in the medium, and can reposition the medium, for example.

A printing apparatus according to a fifth aspect of the present disclosure has a configuration such that in the printing apparatus according to any one of the first to fourth aspects, the carriage includes a measurement unit configured to measure the adjustment pattern.

According to this aspect, the printing apparatus further includes a measurement unit configured to measure the adjustment pattern, and thus, the adjustment pattern can be automatically measured. As a result, the control unit can utilize a measurement result of the measurement unit, and thus, the position of the adjustment pattern printing range in the medium can be easily specified.

A printing apparatus according to a sixth aspect of the present disclosure has a configuration such that in the printing apparatus according to the first to fifth aspects, the distance sensor is a sonic wave sensor.

According to this aspect, the distance sensor is the sonic wave sensor, and thus, the distance to the medium in the printing apparatus can be measured by using sound waves. Thus, for example, even if the medium is a transparent body, the distance to the medium can be reliably measured, and the printing adjustment can be efficiently performed.

A printing adjustment method according to a seventh aspect of the present disclosure uses the printing apparatus according to any one of the first to sixth aspects, and the method includes a measuring step for measuring, by using a distance sensor, a distance to a medium disposed on a platen surface, a specifying step for specifying, based on information of the measured distance, a position of an adjustment pattern printing range, and a printing step for printing the adjustment pattern on the specified adjustment pattern printing range.

According to this aspect, an action effect similar to that in each of the above-described aspects can be obtained.

Note that the printing apparatus typically includes a transport unit configured to transport a medium toward the printing head. In the measuring step, a predetermined number of times the measurement of the distance to the medium by using the distance sensor and the transportation of the medium for a prescribed distance by the transport unit are repeated, and a surface shape of the medium can be acquired based on distance data obtained by the repetition.

In other words, when the medium is transported for a prescribed distance by the transport unit, the surface shape of the medium having a region wider than the region measured by moving the carriage one time can be acquired, and the adjustment pattern printing range can be specified from the acquired surface shape having the wider region. Thus, even when floating partially occurs in the medium, for example, a range of the medium in which floating does not occur can be specified from the remaining range of the medium, and the adjustment pattern can be printed. That is, the printing adjustment can be efficiently performed.

Embodiments

Embodiments of the present disclosure will be described below with reference to FIG. 1 to FIG. 5.

Figure 2:
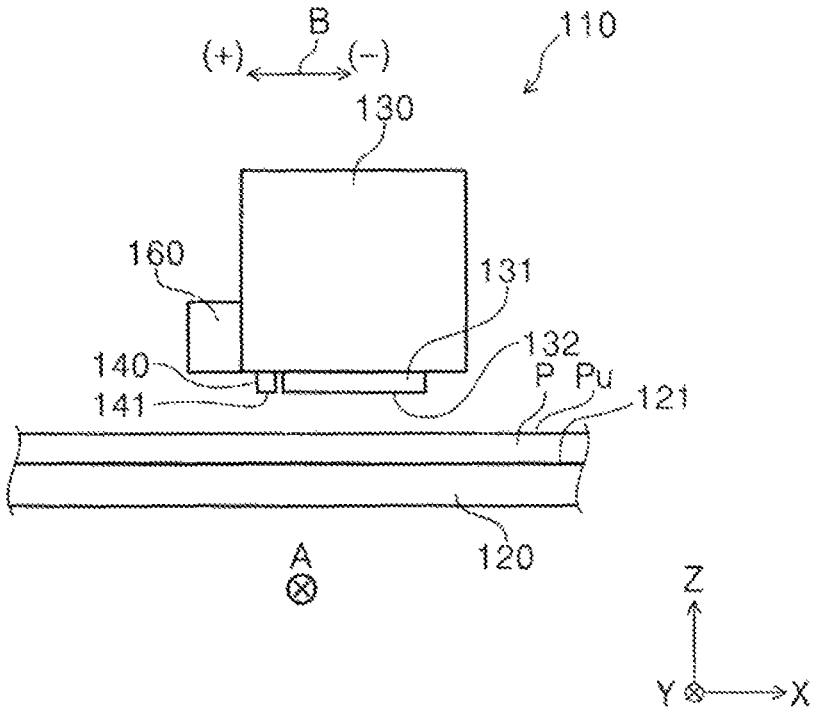
FIG. 2 is a schematic back view of the printing apparatus according to the embodiment.

The following description provides an example of a case in which the present disclosure is implemented, and thus, the technical scope of the present disclosure is not limited to a narrow range. Note that in the drawings, identical or equivalent elements or members are given the same reference numerals, and redundant descriptions thereof will be omitted. In FIG. 1, FIG. 2, and the like, each of the direction X and the direction Y in the drawing is a horizontal direction orthogonal to each other, and the direction Z is a vertical direction.

A printing apparatus 110 according to the embodiment is an inkjet printer, and the configuration thereof will be described with reference to FIG. 1 to FIG. 3.

As illustrated in FIG. 1 and FIG. 2, the printing apparatus 110 includes a platen portion 120 including a platen surface 121 on which a medium P is disposed, and a carriage 130 including a printing head 131, a distance sensor 140, and a measurement unit 160, the carriage 130 being configured to move in a direction B on the platen surface 121.

The printing apparatus 110 further includes a control unit 150 configured to move the carriage 130 to measure, by using the distance sensor 140, a distance Dpi to the medium P at each position i to which the carriage 130 moves, and to specify, based on information of the position i and the distance Dpi, a position of an adjustment pattern printing range 401 in which an adjustment pattern is printed on the medium P.

In the printing apparatus 110 according to the embodiment, a transport direction A of the medium P on the platen surface 121 corresponds to the direction Y, and a movement direction B of the carriage 130 corresponds to the direction X.

Platen Portion and Medium Transport Path

In the embodiment, the medium P is transported, in a transport direction A (+), from a delivery unit 128 through a platen A 122, the platen portion 120, and a platen B 123 that serve as a support portion of the medium P, to a winding unit 129 of the medium P. That is, a path from the delivery unit 128 to the winding unit 129 is a transport path of the medium P in the printing apparatus 100, and the platen A 122, the platen portion 120, and the platen B 123 are the support portion of the medium P disposed in the transport path.

In the embodiment, a driving roller 126 rotated by a transport motor 126A described below is provided between the platen A 122 and the platen portion 120, and a driven roller 127 is disposed above the driving roller 126. The transport unit 125 includes a pair of the driving roller 126 and the driven roller 127.

In the embodiment, the delivery unit 128 rotates in a rotation direction C to deliver the medium P, and the winding unit 129 rotates in the rotation direction C to wind the medium P. That is, a roll type medium P wound with a surface Pu of the medium P facing outward is used, and thus, when the medium P is delivered from the delivery unit 128, the delivery unit 128 rotates a rotary shaft in the rotation direction C.

On the other hand, when a roll type medium P wound with the surface Pu facing inward is used, the delivery unit 128 rotates the rotary shaft in a direction opposite to the rotation direction C to deliver the medium P. When the winding unit 129 winds the medium P to make the surface Pu of the medium P to face outward, the winding unit 129 rotates the rotary shaft in the rotational direction C. On the other hand, when the winding unit 129 winds the medium P to make the surface Pu to face inward, the winding unit 129 rotates the rotary shaft in a direction opposite to the rotation direction C to wind the medium P.

The printing apparatus 110 according to the embodiment is configured to perform recording on the roll-shaped medium P, but the configuration is not limited to such a configuration, and the printing apparatus 110 may be configured to perform recording on a single-sheet medium P. When the printing apparatus 110 is configured to perform recording on the single-sheet medium P, a so-called paper feed (feeding) tray, paper feed (feeding) cassette, or the like, for example, is used for the delivery unit 128 of the medium P. In addition, for example, a so-called discharge receiving unit, paper discharge (discharging) tray, paper discharge (discharging) cassette or the like is used for a collecting unit of the medium P, and for a collecting unit other than the winding unit 129.

Carriage

The carriage 130 includes the printing head 131, the distance sensor 140, and in the embodiment, the measurement unit 160, and is configured to be guided by a guide shaft (not illustrated) to reciprocate in the direction B, in parallel to the platen surface 121. The carriage 130 moves with high positional accuracy based on a control command signal sent from the control unit 150. As a result, the printing head 131 and the distance sensor 140 are accurately moved to a predetermined position of the medium P.

The carriage 130 is reciprocated by a carriage motor 157 (FIG. 3) described below, via a linear motion mechanism such as a pulley and belt mechanism, and a rack and pinion mechanism. The carriage motor 157 is a so-called stepping motor that rotates by an amount based on a pulse amount provided from the motor driving unit 156, for example. Note that the carriage motor 157 is not limited to a stepping motor as long as the carriage motor 157 moves the printing head 131 and the distance sensor 140 with high positional accuracy.

Printing Head

The printing head 131 performs printing on the medium P disposed on the platen surface 121. Specifically, the printing head 131 is provided on a surface of the carriage 130 facing the platen 120 (a surface on the lower side in FIG. 2), and is configured to eject ink from an ejection face 132 of the printing head 131 toward the medium P based on a control command signal sent from the control unit 150 while being reciprocated in the direction B by the carriage 130, to form a desired image.

A plurality of nozzles are disposed on the ejection face 132 of the printing head 131. The plurality of nozzles are provided as a nozzle row in which a plurality of nozzles are arranged in the transport direction A, and N rows of the nozzle rows are provided in the movement direction. Each row of the N rows of nozzle rows is configured to eject ink having a color different from each other, for example.

Distance Sensor

The distance sensor 140 is configured to measure the distance Dpi to the medium P as described above, and is mounted on the carriage 130 to measure the distance Dpi to the medium P. In the embodiment, the distance sensor 140 is mounted to be arranged in line with the printing head 131 in the movement direction B.

As a result, there will be no difference in the transport direction A between a measurement position of the distance sensor 140 and a position at which printing is performed by the printing head 131, and thus, the distance Dpi can be measured simply by moving the carriage 130 without transporting the medium P, and the printing adjustment can be efficiently performed.

In FIG. 2, a reference position for grasping a moving position of the carriage 130 is present at a position (not illustrated) located on the right side (B (−) side) and distant from the current position of the carriage 130. Furthermore, in the embodiment, as illustrated in FIG. 2, in a state in which the carriage 130 starts moving from the reference position, the distance sensor 140 is mounted on a side surface in front (at the B (+) side) in the movement direction B of the carriage 130. That is, the distance sensor 140 is located ahead of the printing head 131. As a result, even when, for example, the medium P has wrinkles of which a size is large enough to be in contact with the printing head 131, the distance sensor 140 can detect the wrinkles earlier than the printing head 131, and thus, operation control to avoid contact with the printing head 131 can be performed.

In the embodiment, the distance sensor 140 is not limited to a specific object as long as the distance sensor 140 can accurately measure the distance Dpi to the medium P. A method for measuring a distance by the distance sensor 140 is preferably in a non-contact manner. Examples of distance measurement types of the distance sensor 140 include sonic wave type, laser type, eddy current type, and capacitance type.

When the distance sensor 140 is sonic wave type, the distance Dpi can be measured even if the material of the medium P is transparent. When the distance sensor 140 is sonic wave type, the frequency of sonic wave used for measurement is a so-called ultrasonic wave of 20 kHz or higher. In addition, when the distance sensor 140 is laser type, the distance Dpi to the medium P can be measured with high accuracy.

Measurement Unit

The measurement unit 160 measures an adjustment pattern printed in the adjustment pattern printing range 401 of the medium P. In the embodiment, the measurement unit 160 is an optical concentration sensor. The measurement unit 160 may be an optical imaging element.

The measurement unit 160 is not particularly limited as long as the measurement unit 160 can measure the adjustment pattern printed in the adjustment pattern printing range 401.

The measurement unit 160 is mounted on the carriage 130 to measure an adjustment pattern printed on the medium P. The measurement unit 160 is mounted to be arranged in line with the printing head 131 in the movement direction B. As a result, the measurement unit 160 can measure an adjustment pattern printed in the adjustment pattern printing range 401 by movement of the carriage 130, without the medium P being transported in the transport direction. Thus, the printing adjustment can be efficiently performed.

Control Unit (Electrical Configuration)

Next, the control unit 150 having an electrical configuration in the printing apparatus 110 according to the embodiment will be described with reference to FIG. 3. The control unit 150 is configured to perform overall control of the printing apparatus 100.

Figure 3:
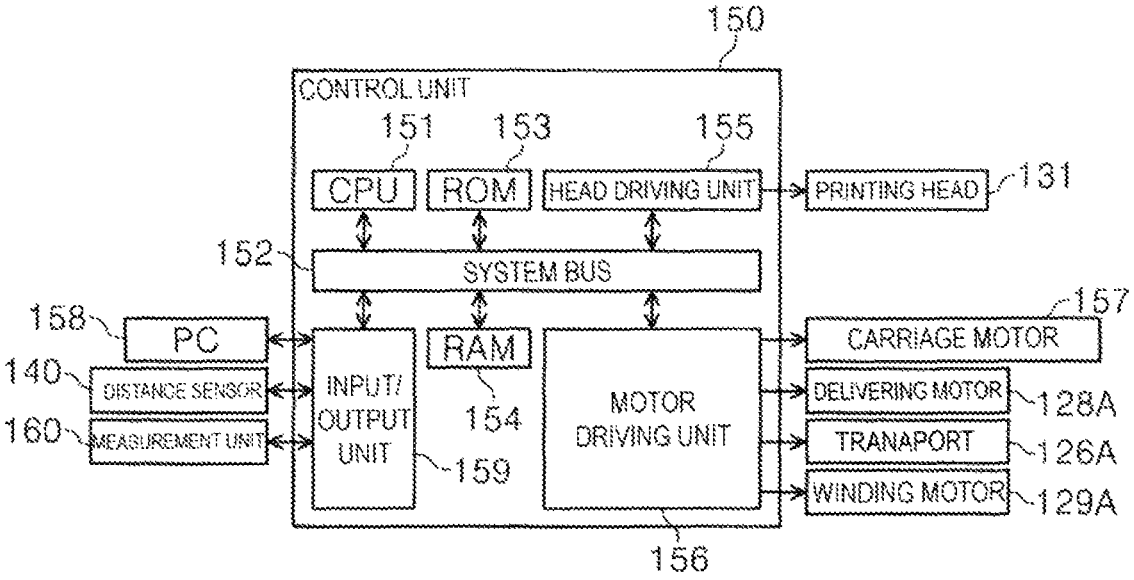
FIG. 3 is a block diagram of the printing apparatus according to the embodiment.

The control unit 150 illustrated in FIG. 3 includes a CPU 151 configured to manage overall control of the printing apparatus 100. The CPU 151 is coupled through a system bus 152 to a ROM 153 configured to store, for example, various types of control programs and maintenance sequences to be implemented by the CPU 151, and to a RAM 154 configured to temporarily store data.

In addition, the CPU 151 is coupled through the system bus 152 to the motor driving unit 156. The motor driving unit 156 is coupled to the carriage motor 157 for moving the carriage 130, a delivering motor 128A being a drive source of the delivery unit 128, the transport motor 126A being a drive source of the driving roller 126, and a winding motor 129A being a drive source of the winding unit 129.

Furthermore, the CPU 151 is coupled through the system bus 152 to an input/output unit 159. The input/output unit 159 is coupled to the distance sensor 140 and a PC 158 being an external device configured to input recorded data and the like into the printing apparatus 100. Furthermore, the CPU 151 is coupled through the system bus 152 to a head driving unit 155 being a drive source of the printing head 131.

Specifying Position of Adjustment Pattern Printing Range

In the embodiment, the control unit 150 is configured to measure, by using the distance sensor 140, the distance Dpi (FIG. 4) to the medium P at each position i in the movement direction (direction B), and to acquire a surface shape 400 of the medium P corresponding to measurement positions based on the distances Dpi measured at a plurality of positions. Here, the distance Dpi refers to a distance measured by the distance sensor 140, from a sensor face 141 to the surface Pu (FIG. 2) of the medium P.

Then, the control unit 150 determines based on the surface shape 400 whether there is a region in which the change in the distance Dpi at each position i is equal to or less than a predetermined amount, that is, a planar region available for printing an adjustment pattern. If there is a planar region available for printing the adjustment pattern, the region is specified as the position of the adjustment pattern printing range 401. Here, the "predetermined amount" corresponds to the planarity of the medium. It is preferable that the "predetermined amount" is previously prepared in plurality in relation to the required print quality, to be selectable by a user.

Note that the control unit 150 may not perform arithmetic processing to obtain the surface shape 400 as described above, but may be configured to directly search, based on the distances Dpi at the plurality of positions, a planar region to specify the position of the adjustment pattern printing range 401.

In other words, the control unit 150 is configured to move the carriage 130 to measure, by using the distance sensor 140, the distance Dpi to the medium P at each position i, and to specify the position of the adjustment pattern printing range 401 in the medium P, based on the information of the change in the distance Dpi.

The control unit 150 is further configured to notify a user when there is no planar region and the adjustment pattern printing range cannot be specified, as a result of measuring the distance to the medium P measured by the distance sensor 140.

An examples of the means for notifying the user from the control unit 150 includes a configuration in which a monitor and a speaker (not illustrated) for communicating the content of notification are coupled through the PC 158 to the control unit 150. Furthermore, the control unit 150 may be connected to a network environment via the PC 158 as a means for notifying the user. Note that the means for notifying the user from the control unit 150 is not particularly limited as long as the content of notification can be communicated to the user.

Printing Adjustment Method

Figure 4:
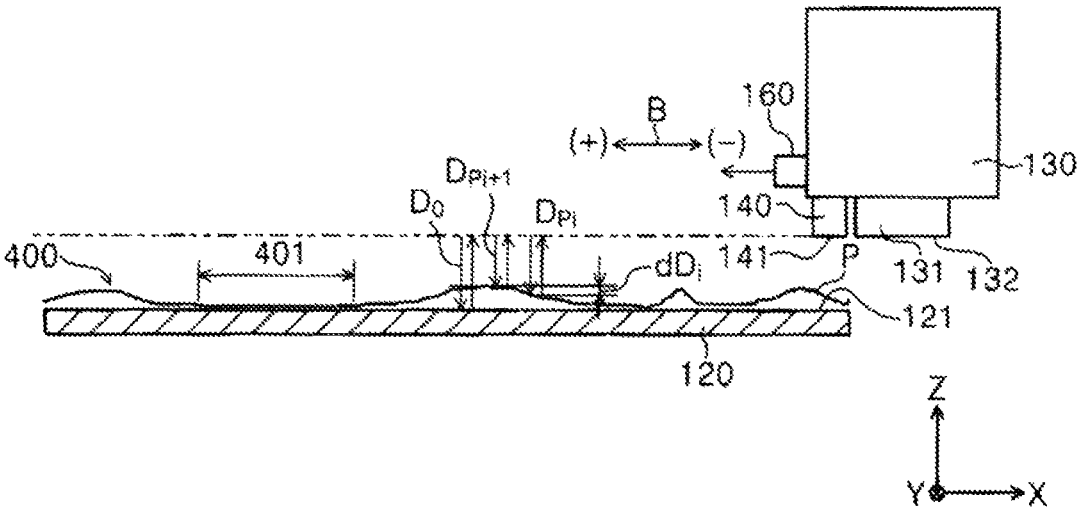
FIG. 4 is a schematic back view illustrating measurement of a change in a distance to a medium disposed on a platen surface, according to the embodiment.
Figure 5:
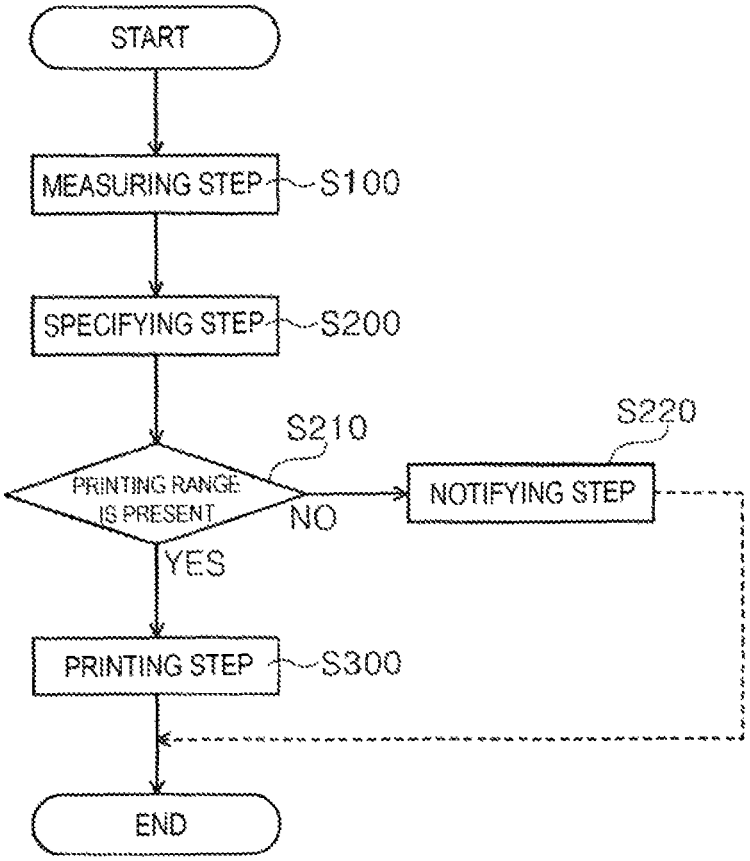
FIG. 5 is a flowchart illustrating a printing adjustment method according to the embodiment.

A printing adjustment method according to the embodiment of the present disclosure will be described below with reference to FIG. 4 and FIG. 5. The printing adjustment method according to the embodiment is performed by using the printing apparatus 110.

First, in a measuring step of step S100, the carriage 130 is moved, and the distance Dpi to the medium P is measured by the distance sensor 140 at a measurement position i designated in advance. Data of the measurement position i and the distance Dpi is sent from the input/output unit 159 to the control unit 150. The data of the position i and the distance Dpi sent to the control unit 150 is recorded, for example, in the RAM 154, and the control unit 150 performs, based on the data, arithmetic processing by an arithmetic program stored in the ROM 153 to acquire the surface shape 400.

In a specifying step of step S200, processing is performed for specifying, based on the surface shape 400 acquired in step S100, the adjustment pattern printing range 401 in which the adjustment pattern is printed. Alternatively, the arithmetic processing for obtaining the surface shape 400 is not performed, but processing is performed for directly searching, based on the distances Dpi at the plurality of positions, a planar region to specify the position of the adjustment pattern printing range 401. In the processing in step S200, a range, among the acquired surface shapes 400, in which a continuous section having a predetermined amount or less of change dDpi in the distance Dpi (FIG. 4) at each of the positions in the medium P is equal to or greater than a predetermined length, is specified as the adjustment pattern printing range 401 in which the adjustment pattern is printed. The position of the specified adjustment pattern printing range 401 is recorded, for example, in the RAM 154.

After step S200, in step S210, it is determined based on the surface shape 400 whether there is a region in which is available as the adjustment pattern printing range 401, that is, whether there is a printing range for the adjustment pattern. If it is determined that there is not the printing range for the adjustment pattern in step S210, the processing in the embodiment proceeds to a notifying step of step S220, and the user is notified that there is not the printing range. This allows the user to reposition the medium P, for example, and the printing adjustment can be efficiently performed.

The content to be notified in step S220 may be the measurement result of the distance to the medium P, for example, and include influence on printing by the measurement result. In addition, if the change dD in measured distance to the medium P is equal to or greater than a value given in advance, the content to be notified may indicate, to the user, that the change dD is equal to or greater than the value.

In step S210, if it is determined that there is the printing range for the adjustment pattern, the processing proceeds to a printing step of step S300 for printing the adjustment pattern in the specified adjustment pattern printing range. Thereafter, the adjustment pattern printed in the adjustment pattern printing range is measured by the measurement unit 160, and ink ejection timing of the printing head 131 and the like are adjusted based on the measurement result.

Other Embodiments (1) For the adjustment pattern printing range 401 specified in step S200, instead of being specified as a region in which the change in the distance Dpi to the medium P is equal to or less than a predetermined amount, the following may be applied.

A region in which a continuous section having a predetermined amount or less of change in a difference dD0*i* between the distance Dpi to the medium P and a distance DO to the platen surface is equal to or greater than a predetermined length, is specified as the adjustment pattern printing range 401 in which the adjustment pattern is printed.

(2) Combination with Transportation by Transport Unit

The printing apparatus 100 such as an inkjet printer typically includes a transport unit 125 configured to transport the medium P toward the printing head 131. In the measuring step of step S100, a predetermined number of times the measurement of the distance to the medium P by using the distance sensor 140 and the transportation of the medium P for a prescribed distance by the transport unit 125 are repeated, and the surface shape of the medium P may be acquired based on distance data obtained by the repetition.

In other words, when the medium P is transported for a prescribed distance by the transport unit 125, the surface shape of the medium P having a region wider than the region measured by moving the carriage 130 one time can be acquired, and the adjustment pattern printing range 401 can be specified from the acquired surface shape having the wider region. Thus, even when floating partially occurs in the medium P, for example, a range of the medium P in which floating does not occur can be specified from the remaining region of the medium P, and the adjustment pattern can be printed. That is, the printing adjustment can be efficiently performed.

What is claimed is:

1. A printing apparatus comprising:

a platen portion including a platen surface on which a medium is disposed;

a carriage including a printing head and a distance sensor, the carriage being configured to move; and a control unit configured to move the carriage to measure, by using the distance sensor, a distance to the medium at each position, and to specify, based on information of the position and the distance, a position of an adjustment pattern printing range in the medium.

2. The printing apparatus according to claim 1, wherein the adjustment pattern printing range is a region in which a change in the distance to the medium is equal to or less than a predetermined amount.

3. The printing apparatus according to claim 1, wherein the adjustment pattern printing range is a region in which a difference between the distance to the medium measured by the distance sensor and a distance from the distance sensor to the platen surface is equal to or less than a predetermined value.

4. The printing apparatus according to claim 1, wherein the control unit is configured to issue a notification when failing to specify the adjustment pattern printing range.

5. The printing apparatus according to claim 1, wherein the carriage includes a measurement unit configured to measure an adjustment pattern.

6. The printing apparatus according to claim 1, wherein the distance sensor is a sonic wave sensor.

7. A printing adjustment method using the printing apparatus according to claim 1, the method comprising:

a measuring step for measuring a distance to a medium by using a distance sensor;

a specifying step for specifying, based on information of the distance measured, a position of an adjustment pattern printing range; and a printing step for printing an adjustment pattern in the adjustment pattern printing range specified.

* * * * *